US006925783B1

(12) United States Patent
Pearson

(10) Patent No.: US 6,925,783 B1
(45) Date of Patent: Aug. 9, 2005

(54) PACKAGING SYSTEM AND RELATED METHOD

(76) Inventor: Walter G. Pearson, 104 Hilltop Dr., Pineville, LA (US) 71360

( * ) Notice: Subject to any disclaimer, the term of this patent is extended or adjusted under 35 U.S.C. 154(b) by 0 days.

(21) Appl. No.: 10/778,283

(22) Filed: Feb. 13, 2004

(51) Int. Cl.[7] ..... B65B 5/10

(52) U.S. Cl. ..... 53/475; 53/243; 53/247; 53/539

(58) Field of Search ..... 53/473, 475, 467, 53/471, 243, 247, 248, 249, 255, 539

(56) References Cited

U.S. PATENT DOCUMENTS

| | | | | | |
|---|---|---|---|---|---|
| 1,874,393 | A | * | 8/1932 | Vignaux, Jr. et al. | 53/247 |
| 2,704,685 | A | | 3/1955 | Tyler et al. | |
| 3,300,945 | A | * | 1/1967 | Grossi et al. | 53/247 |
| 3,316,688 | A | * | 5/1967 | Niederer et al. | 53/243 |
| 3,545,164 | A | * | 12/1970 | Middleton | 53/247 |
| 3,780,856 | A | | 12/1973 | Braverman | |
| 3,789,575 | A | * | 2/1974 | Bross | 53/539 |
| 3,848,395 | A | | 11/1974 | Totten | |
| 3,871,132 | A | * | 3/1975 | Brink | 47/57.6 |
| 4,026,091 | A | * | 5/1977 | Pearson | 53/247 |
| 4,168,002 | A | * | 9/1979 | Crosby | 206/459.5 |
| 4,573,609 | A | * | 3/1986 | Tesch, Jr. | 53/247 |
| 4,685,271 | A | | 8/1987 | Ringer et al. | |
| 4,693,057 | A | | 9/1987 | Rittinger et al. | |
| 5,228,916 | A | * | 7/1993 | Berta | 118/30 |
| 5,255,618 | A | * | 10/1993 | Berry | 53/247 |

(Continued)

OTHER PUBLICATIONS

Author unknown; "Cata Miranda" catalog; printed 2004; pp. 370-391.

(Continued)

*Primary Examiner*—Louis Huynh
(74) *Attorney, Agent, or Firm*—Sieberth & Patty, L.L.C.

(57) ABSTRACT

Apparatus for packaging a plurality of objects, the apparatus including (i) a vacuum chamber housing which defines an opening sized and configured to receive, and be placed in a substantially sealed relationship with, a planar member having a bottom surface and a top surface, which top surface in turn defines an array of recesses, each of the recesses being sized and configured to receive one of the objects, and which planar member further defines a plurality of fluid passageways extending through the planar member, each of the plurality of fluid passageways opening in a respective one of the recesses defined by the planar member and extending completely through the planar member to a passageway opening in the bottom surface of the planar member, (ii) a support member pivotally attached to the vacuum chamber and sized and configured to receive a sheet which forms an array of blister-like chambers for receiving at least a portion of the plurality of objects, and (iii) a switch configured for operative connection to a vacuum pump in fluid communication with the vacuum chamber, the switch being disposed to enable a user to turn off the vacuum pump after the vacuum chamber is pivoted to a position in which the opening of the vacuum chamber and the planar member in sealed relation therewith are above the support member and the sheet when the sheet has been received by the support member and the array of blister-like chambers and the array of recesses are substantially aligned. The invention also concerns related component devices and methods of packaging objects.

6 Claims, 5 Drawing Sheets

U.S. PATENT DOCUMENTS

| | | | | | |
|---|---|---|---|---|---|
| 5,271,209 | A | * | 12/1993 | Boyhan | 53/473 |
| 5,457,933 | A | * | 10/1995 | LaVars et al. | 53/247 |
| 5,542,236 | A | * | 8/1996 | Miller | 53/475 |
| 5,661,949 | A | * | 9/1997 | Blanc | 53/247 |

OTHER PUBLICATIONS

Author unknown; "Medi-Dose" brochure pages; publication date unknown; 5 pages; Printed 1996.

* cited by examiner

PACKAGING SYSTEM AND RELATED METHOD

FIELD OF THE INVENTION

The present invention relates to packaging systems, and especially to packaging systems for objects such as pills (i.e., pills, tablets, capsules, caplets and the like).

BACKGROUND

Systems for packaging small objects for easy dispensing have been the subject of significant research and development. Especially in the field of pharmaceutical products, the accurate packaging of pills, tablets, capsules and the like, has been the focus of industry development and governmental regulation. Accurate dispensation of pharmaceutical products to those in need of such products has been the subject of research and development due to increasing costs associated with the products themselves, as well as concerns over damage caused by inaccurate dispensation of such medications.

Notwithstanding prior efforts to develop such packaging systems, known systems for packaging objects, and in particular for packaging small objects like pills, tablets, capsules and the like, involve a significant level of complexity and commercial scale which makes most of them unsuitable for many applications. For instance, in nursing home settings, home health agencies, outpatient medical facilities and the like, there are very few choices, if any, which provide a convenient, table-top-scale system for accurately and conveniently re-packaging pharmaceutical products purchased in bulk.

Thus, there remains a need for a system or method which facilitates the convenient and accurate packaging and labeling of pharmaceutical products and/or other objects intended for later dispensation and use.

SUMMARY OF THE INVENTION

The present invention is deemed to meeting the foregoing need, amongst others, by providing in one embodiment a device for receiving a plurality of objects and for facilitating placement of the objects in an array of blister-like chambers formed by a sheet for receiving a plurality of objects. In this embodiment, the device comprises a planar member having a top surface and a bottom surface, wherein the top surface defines an array of recesses configured for substantial alignment with the array of blister-like chambers, wherein all of the recesses defined by the planar member are substantially uniform in size and each recess is sized and configured so that substantially all of one of the plurality of objects may fit therein.

Another embodiment of the present invention provides a device comprising (a) a planar member which defines a plurality of recesses, each of the recesses being sized and configured to receive an object, and wherein the planar member further defines one or more fluid passageways extending through the planar member, each passageway opening in a respective one of the recesses defined by the planar member, (b) a vacuum pump configured to be placed in fluid communication with the one or more fluid passageways extending through the planar member, and (e) an on-off switch operatively connected to the vacuum pump for controlling the level of vacuum provided within the one or more fluid passageways and the recesses defined by the planar member.

Yet another embodiment of the present invention provides apparatus for packaging a plurality of objects. The apparatus comprises the following components:

(1) a vacuum chamber housing which defines an opening sized and configured to receive, and be placed in a substantially sealed relationship with, a planar member having a bottom surface and a top surface, which top surface in turn defines an array of recesses, each of the recesses being sized and configured to receive one of the objects, and which planar member further defines a plurality of fluid passageways extending through the planar member, each of the plurality of fluid passageways opening in a respective one of the recesses defined by the planar member and extending completely through the planar member to a passageway opening in the bottom surface of the planar member, (2) a support member pivotally attached to the vacuum chamber and sized and configured to receive a sheet which forms an array of blister-like chambers for receiving at least a portion of the plurality of objects, and (3) a switch configured for operative connection to avacuumpump in fluid communication with the vacuum chamber, the switch being disposed to enable a user to turn off the vacuum pump after the vacuum chamber is pivoted to a position in which the opening of the vacuum chamber and the planar member in sealed relation therewith are above the support member and the sheet when the sheet has been received by the support member and the array of blister-like chambers and the array of recesses are substantially aligned.

Still another embodiment of the present invention is a method for packaging a plurality of objects. The method comprises the steps of (a) placing the plurality of objects on a top surface of a planar member which defines an array of recesses, each of the recesses being sized and configured to receive one of the plurality of objects, (b) sweeping at least some of the plurality of objects across the top surface to insure that each of the recesses has received a respective one of the objects, (c) removing all of any excess number of the plurality of objects from the top surface, (d) placing in contact with, or at least in close proximity to, the top surface a sheet which forms an array of blister-like chambers for receiving at least a portion of the plurality of objects, the array of recesses of the top surface being substantially aligned with and opening into the blister-like chambers of the sheet, (e) while retaining the sheet in contact with or in close proximity to the top surface, rotating the planar member sufficiently to cause each of the objects to be transferred from its respective recess to a corresponding blister-like chamber of the sheet.

In another embodiment, the method further includes the step of placing an adhesive-backed, backing into adhering contact with the sheet to thereby enclose each of the plurality of objects within a respective one of the blister-like chambers of the sheet. The method may also further include the step of placing visual or machine readable markings upon the backing, the visual or machine readable markings be configured to convey information about the contents to be enclosed within each blister-like chamber. The plurality of objects may be a plurality of pills, tablets, capsules or the like.

Yet another embodiment of this invention is another method of packaging a quantity of objects. The method comprises the steps of (a) placing a plurality of the objects on a top surface of a planar member which defines an array of recesses, each of the recesses being sized and configured to receive one of the objects, and which planar member further defines a plurality of fluid passageways extending through the planar member, each of the plurality of fluid passageways opening in a respective one of the recesses defined by the planar member and extending completely through the planar member to a passageway opening in a bottom surface of the planar member, (b) sweeping at least some of the plurality of the objects across the top surface to insure that each of the recesses has received a respective one of the objects, (c) removing all of any excess number of the objects from the top surface, (d) providing a vacuum in the space proximate to each of the passageway openings in the bottom surface of the planar member, the vacuum being sufficient to retain each object within its respective recess at least during rotation of the planar member, (e) placing in contact with, or at least in close proximity to, the top surface a sheet which forms an array of blister-like chambers for receiving a plurality of the objects, the array of recesses of the top surface being substantially aligned with and opening into the blister-like chambers of the sheet, (f) while retaining the sheet in contact with or in close proximity to the top surface, rotating the planar member so that the bottom surface is substantially above the top surface, and (g) removing the vacuum from the space proximate to the passageway openings in the bottom surface to cause each object to fall from its respective recess into a corresponding blister-like chamber of the sheet.

In another embodiment, the method further includes the step ofplacing an adhesive-backed, backing into adhering contact with the sheet to thereby enclose each of the objects within a respective one of the blister-like chambers of the sheet. The method may also further include the step of placing visual or machine readable markings upon the backing, the visual or machine readable markings be configured to convey information about the contents to be enclosed within each blister-like chamber.

These and other embodiments, objects, advantages, and features of this invention will now become apparent from the following description, accompanying drawings and appended claims.

BRIEF DESCRIPTION OF THE DRAWINGS

In each of the above figures, like numerals or letters are used to refer to like or functionally like parts among the several figures.

DETAILED DESCRIPTION OF THE INVENTION

As will now be appreciated, certain embodiments of the present invention not only enable a user to place, respectively, a plurality of objects into a plurality of blister-like chambers in a sheet, but also enable the user to label each object being packaged so that necessary information associated with the packaged object can be associated with each object. For instance, in the pharmaceuticals field, systems and methods of this invention enable the labeling of each unit dose to be packaged so that the product and/or its recipient may be identified properly, to help insure that the correct medicine in the correct amount is provided to the correct patient at the correct time.

The objects to be packaged in accordance with this invention may vary widely, but will typically include objects which are relatively small in size (less than 10 $cm^2$, and preferably less than 1 $cm^2$) with an average width, average thickness and an average length which can vary. In a preferred embodiment, the objects are pharmaceutical products which are distributed as solid or semi-solid objects in the form of pills, tablets, capsules, caplets or the like. It should be appreciated, however, that other larger objects, e.g., syringes or any other object or device conveniently packaged in the type of sheets disclosed in this description, may be packaged by employing a system or method of this invention.

The sheet into which the objects are placed will form an array of blister-like chambers. The number of recesses in the array in a given sheet will vary based upon the intended use of the sheet and the size of the objects to be placed in the recesses. Typical recess arrays in preferred sheets will have 500 or fewer recesses. A fewer number of recesses may be more desirable when an adhesive backing with space for printed matter or other optical indicia is used to convey information about the contents of each recess. The circumference and depth of each recess may also vary widely, but preferably each recess will be sized to facilitate placement of an object within the recess without having any portion of the object extend above the plane occupied by the flat surface of the sheet, so that any adhesive backing may fit neatly against the sheet without obstruction. The recesses are also preferably sized so that only one object may be placed into a respective recess, to avoid inadvertent placement of multiple objects into a recess. When the objects to be placed in the recesses are pharmaceutical in nature, the sheet preferably is made of a flexible, clear plastic material suitable for storing pharmaceutical products. Also in such circumstance, the sheet is preferably perforated so that the sheet material surrounding each recess may be separated from the adjacent recesses to facilitate dispensation of the contents of each recess on a individualized basis.

Figure 1:
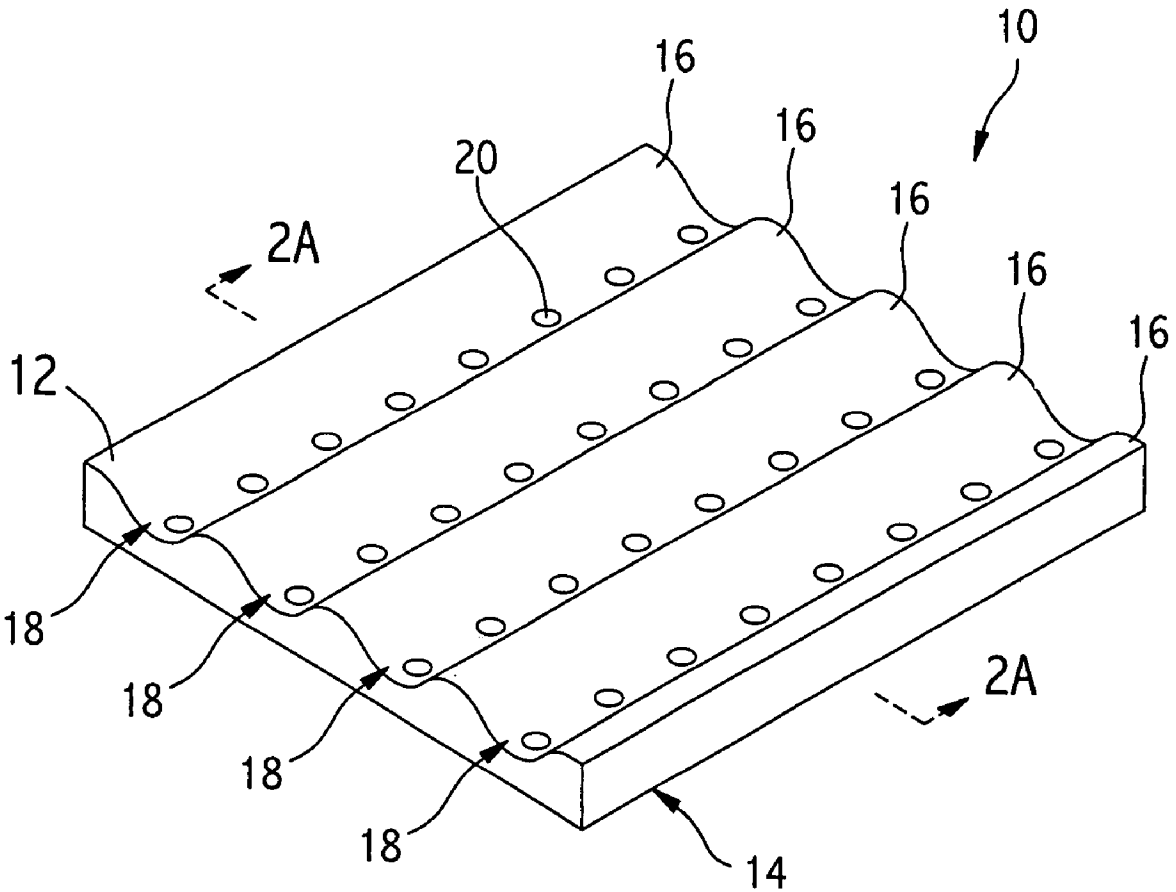
FIG. 1 is a side view in perspective of a preferred device of this invention.
Figure 2A:
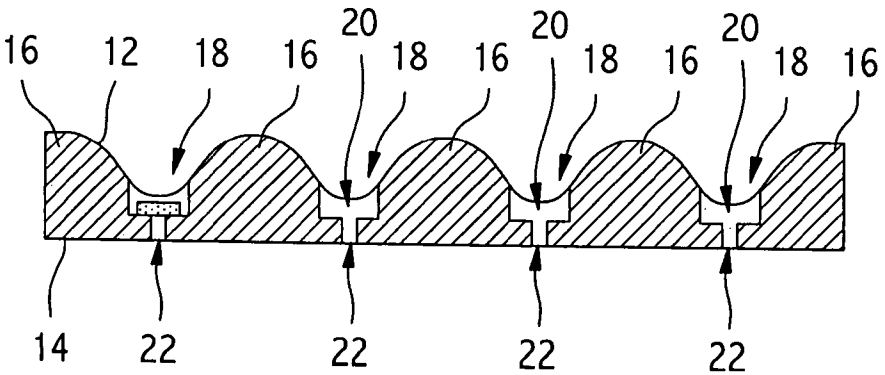
FIG. 2A is a cross-sectional view of the device of FIG. 1, taken along lines 2A—2A shown in FIG. 1.

Referring now to the drawings, a preferred device of this invention is illustrated in FIGS. 1 and 2A, which depict a planar member 10 having a top surface 12 and a bottom surface 14. Top surface 12 is characterized by a plurality of substantially linear and substantially parallel undulations formed by a plurality of rounded rails 16 disposed in parallel fashion relative to one another so as to define a plurality of grooves 18 therebetween. Top surface 12 also defines a plurality of recesses 20, each recess 20 being disposed within a respective groove 18, each groove 18 having disposed along its length a plurality of recesses 20 disposed therein. Each recess 20 has associated with it a respective fluid passageway 22 extending through member 10 and through top surface 12 and bottom surface 14.

In some embodiments of this invention, it may be preferable for the planar member recesses to be sized and configured to receive substantially all of one, and even more preferably only one, object to be loaded into a blister-like chamber of the target sheet. In this way, the planar member may be more specifically configured to the particular object being loaded into the chambers of the sheet, to avoid loading of multiple objects into a chamber inadvertently. However, this configuration of the planar member may require that different objects having different sizing be loaded using planar members particularly sized for those objects, so that the user who loads a variety of objects into target sheets may wish to have a number of planar members at his or her disposal. It should also be noted that the planar member may be fabricated from a wide variety of materials, but will preferably be fabricated from a material which itself provides a fairly smooth top surface, or provides a surface which can be made smooth and slick through the application of a slicking agent to facilitate movement of objects across the top surface.

Another embodiment of the present invention provides an alternative configuration of the planar member. In particular, as may be seen in FIG. 2B, an alternative planar member 10 is comprised of a base portion 11 and removable rounded rails 16*a*. As illustrated, each rail 16*a* is connected to base portion 11 through a dove-tailed tongue 13 which runs the length of the rail and a corresponding groove 15 in base portion 11. In this way, rails 16*a* may be separated from base portion 11 so that a sheet which forms an array of blister-like chambers may be placed flush against a top surface 17 of base portion 11. When base portion 11 is then rotated while the sheet (see FIG. 4) is held flush against the top surface in order to transfer the contents of recesses 20 into the blister-like chambers of the sheet, the chance that the contents of recesses 20 will fall outside of a corresponding blister-like chamber of the sheet is reduced. It should be appreciated that other means of attaching each rail 16*a* to base portion 11 may be envisioned and feasible. For example, mechanical snaps, screws, magnets, hook and loop fastening material and the like, as well as many other attachment means may be employed to connect each rail to the base portion so that the rails may be removed after filling recesses 20, in order to facilitate transfer of the objects from recesses 20 to the blister-like chambers of the target sheet further illustrated in FIG. 4 and described in detail below.

Figure 2B:
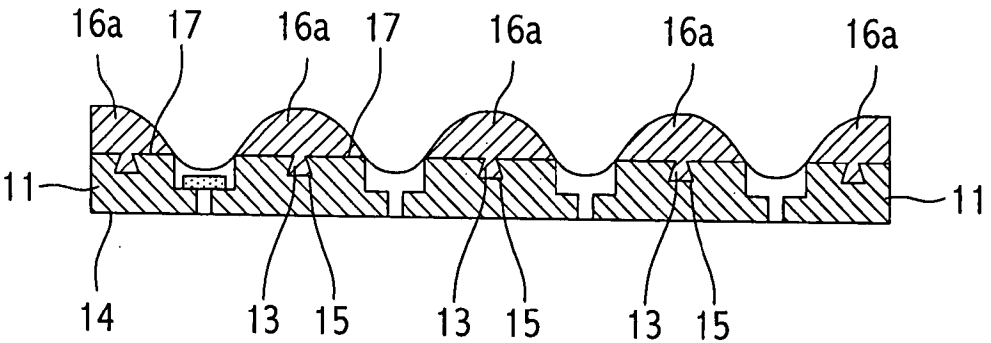
FIG. 2B is a cross-sectional view of a device similar to that of FIG. 1, as illustrated in FIG. 2A, but modified to illustrate removable, groove-forming rails in accordance with another embodiment of this invention.
Figure 3:
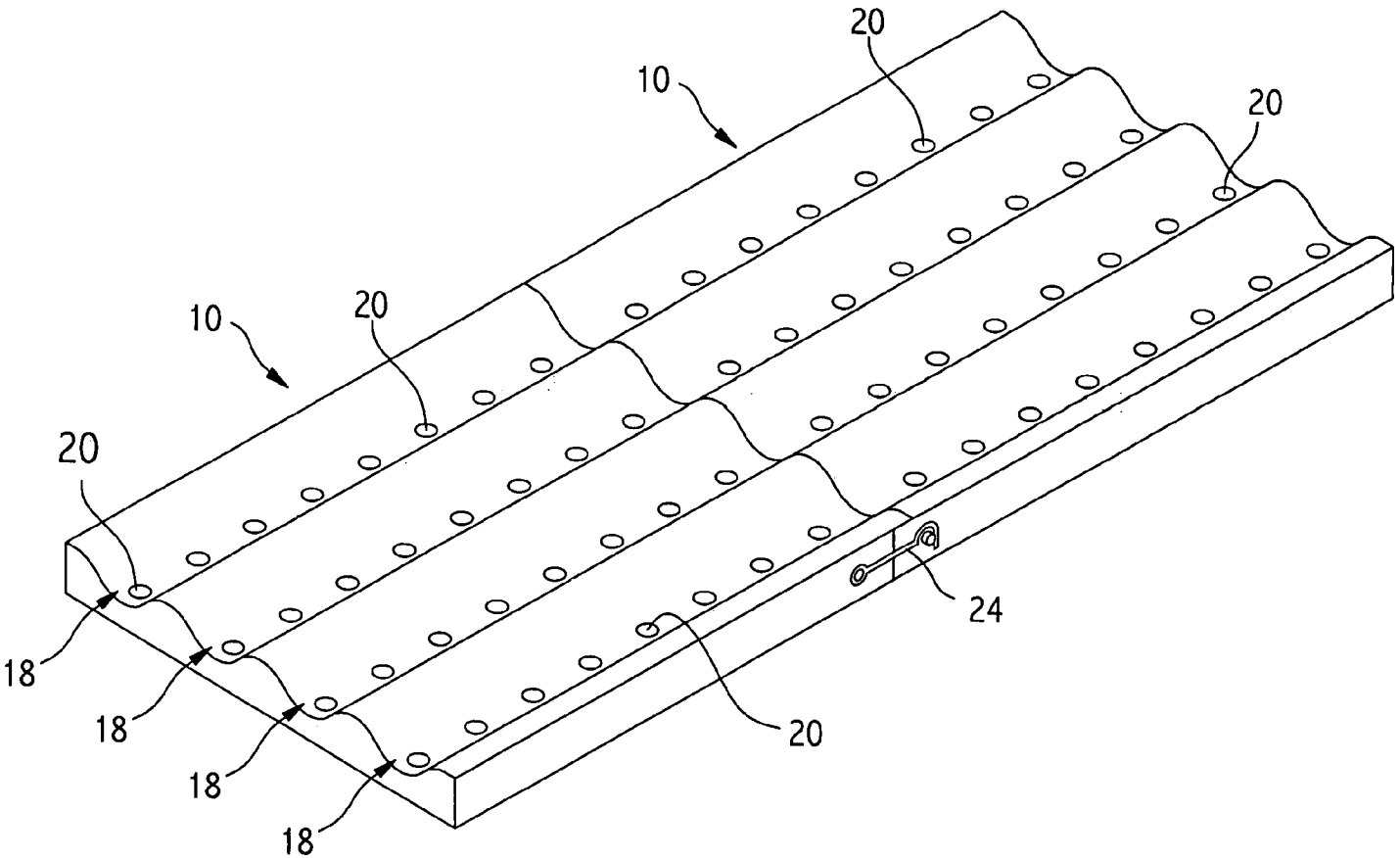
FIG. 3 is a side view in perspective of two devices in accordance with FIG. 1 connected to one another.

Another embodiment of the invention provides for attachment of multiple planar members 10, 10 to one another, as illustrated in FIG. 3. The planar members 10, 10 in FIG. 3 are aligned and connected to one another, end-to-end as illustrated, by attachment means in the form of a latch 24. Of course, here again, other attachment means, like those described above with respect to rails 16*a* (FIG. 2B) may be envisioned and are within the scope and spirit of the invention. In this way, additional planar member recesses 20 may be filled with ease by one swipe of objects across elongated grooves 18 formed by end-to-end aligned planar members 10, 10. Of course, any number of attachable planar members could be so aligned and attached to elongate even further the recess-containing grooves, thereby increasing even more the number of recesses which could be filled with a single deposit and swipe of objects across the grooves.

Figure 4:
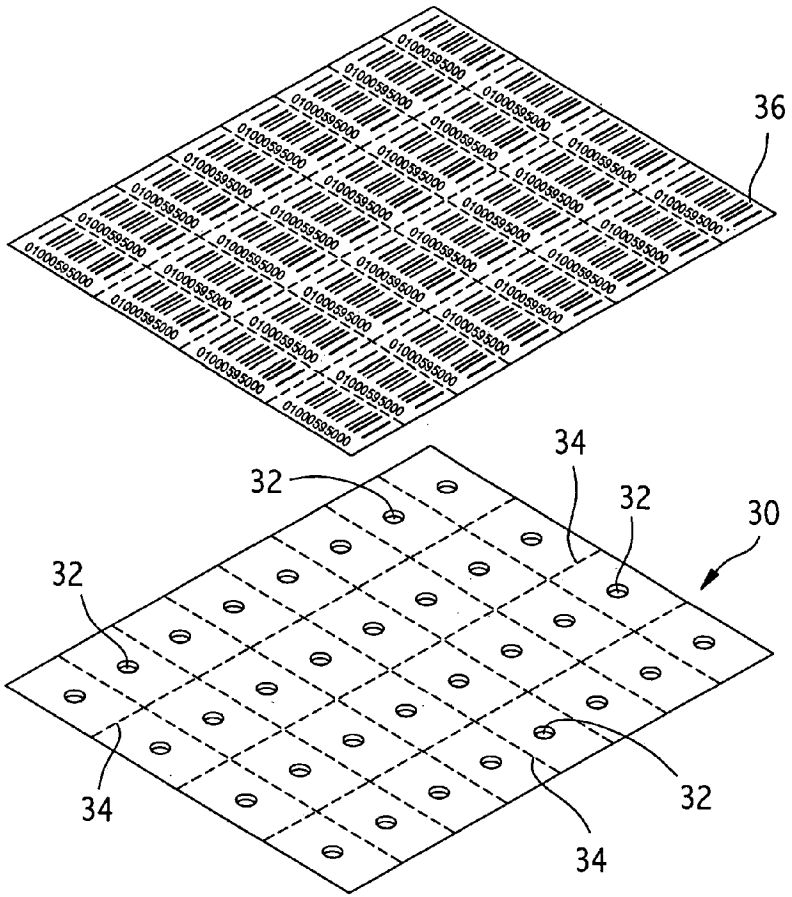
FIG. 4 is a side view in perspective of a sheet which forms an array of blister-like chambers for use with the device of FIG. 1 in accordance with an embodiment of this invention. An adhesive backing for the sheet is also illustrated as suspended above the sheet and bearing optically perceivable information.

FIG. 4 illustrates an exemplary target sheet 30 for use in accordance with the present invention. A plurality of blister-like chambers 32 are arrayed across sheet 30, and a perforation pattern 34 through sheet 30 enables separation of the portions of sheet 30 surrounding each chamber 32 from the rest of sheet 30. As illustrated, a backing 36 is suspended above sheet 30. Preferably, backing 36 includes an adhesive on the side adjacent to sheet 30, the adhesive being patterned so as to provide adhesive only in a pattern which excludes the area above each chamber 32. In this way, when backing 36 is placed in adhering contact with sheet 30, adhesive is not present in the enclosed space formed by the walls of the blister-like chambers 32 and the adjacent portion of sheet 30, to avoid adhesive from coming into contact with the contents of chambers 32. Backing 36 is also preferably configured to permit printing of information (e.g., bar coding, text, etc.) on the side opposite from sheet 30, so that information related to the contents of each chamber 32 may be printed thereon.

Figure 5:
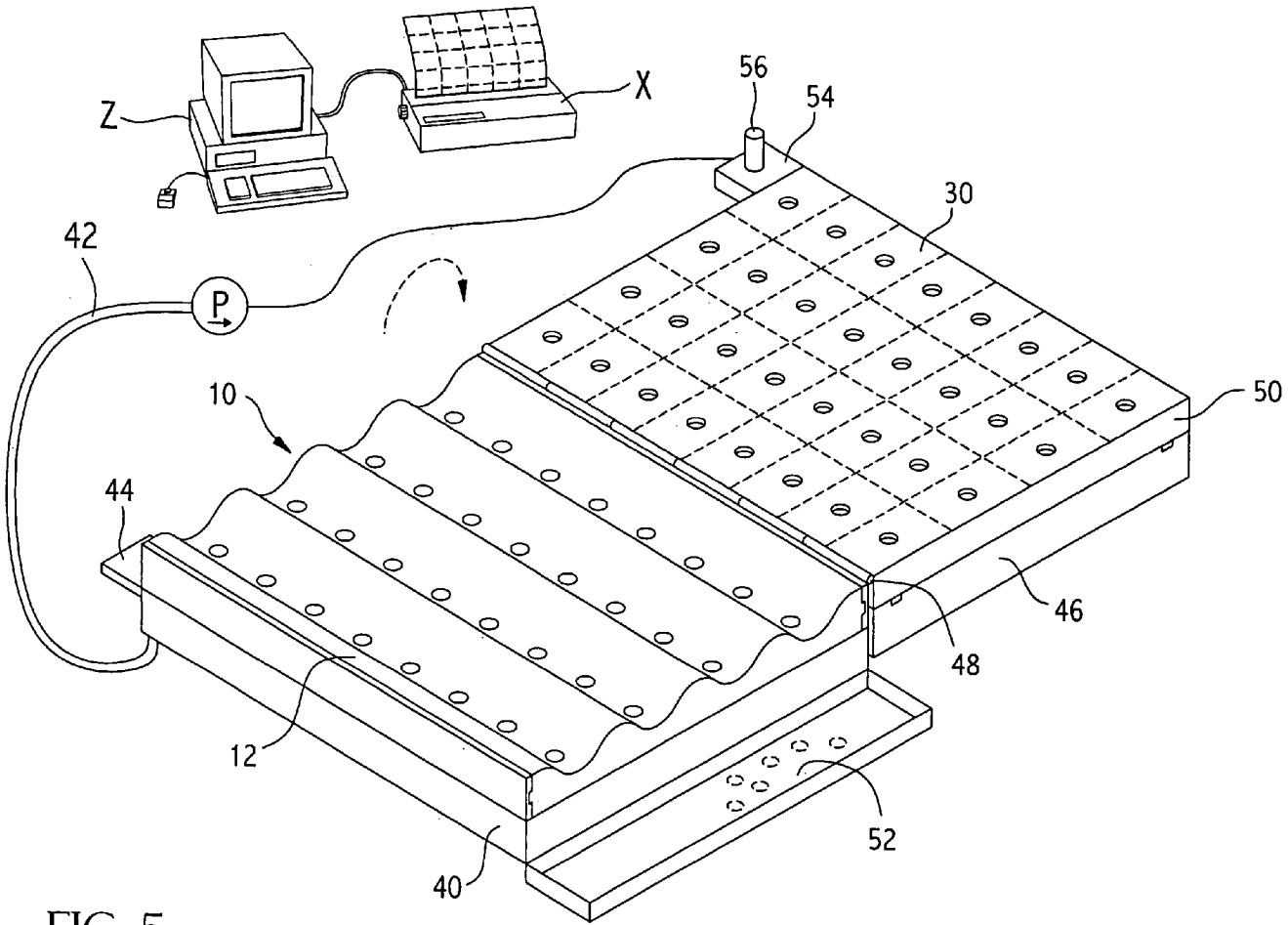
FIG. 5 is a side view in perspective of a preferred apparatus and system of this invention.

A preferred apparatus employing the device of FIG. 1 to provide a system in accordance with this invention is illustrated in FIG. 5. There it can be seen that planar member 10 is engaged with a vacuum chamber 40 so as to enclose the space within chamber 40. Chamber 40 is in fluid communication with a vacuum pump P through a vacuum hose 42. Chamber 40 has extending from one end a flange 44, and is connected to a template support 46 by a hinge 48. Template support 46 supports a template 50 upon which is placed sheet 30. A receptacle 52 is disposed adjacent to chamber 40 for receiving excess objects when they are swept across top surface 12. Template support 46 further includes a flange 54 which is provided with an electrical on-off switch 56 operatively connected to pump P.

In operation, when switch 56 is actuated to "on," pump P forms a vacuum within vacuum chamber 40. This vacuum in turn creates a vacuum within each fluid passageway 22 (see FIG. 2A) extending through planar member 10 and opening into respective recesses 20. During such operation, objects may be swept across grooves 18 of planar member 10 until each recess 20 contains one of the objects and the vacuum formed in each respective fluid passageway 22 (see FIG. 2A) tends to draw the object toward the floor of a respective recess 20. Once the desired number of recesses contain objects respectively, vacuum chamber 40 may be lifted and pivoted relative to template support 46 in the direction of the arrow indicated in FIG. 5 until top surface 12 of planar member 10 is disposed directly above target sheet 30. When flange 44 comes into contact with switch 56, switch 56 is then actuated to "off" so that pump P is switched off, whereupon the contents of each recess 20 drop into a corresponding and adjacent chamber 32 of sheet 30. Before, during or after this operation, a sheet of backing 36 may be printed using a printer X optionally controlled by a computer Z. Using the computer, and typically appropriate and commercially available label printing software, the information to be printed on backing 36 may be customized for the particular objects deposited into sheet 30, with suitable information such as, e.g., patient identification information and/or chamber contents identification information, including bar coding if desired. Of course, when only a portion of chambers 32 of sheet 30 are to be filled, using computer Z the print placed on backing 36 can be edited so that print is placed only on the portion of backing 36 covering filled chambers 30. In some cases, it will be desirable to configure computer Z with a bar code reader (not shown) so that bulk objects which are labeled with bar coding (e.g., a national drug code in bar code form) can be read into the system for labeling individual objects from the bulk container in a consistent manner. It also may be desirable to configure the computer with a database to store desired information, such as bar coding information, for preselected objects or products, to reduce the possibility of human error when inputting data for printing on the backing and to generally facilitate use of the system.

It should be appreciated that, in some cases, use of the apparatus of FIG. 5 may cause additional objects to fall within a recess 20 of planar member 10 inadvertently, especially when the recess size is large enough, relative to the objects being loaded, to permit more than one object to fall within a recess 20. In such a case, after a vacuum is formed in chamber 40 as previously described, vacuum chamber 40 may be lifted and pivoted relative to template support 46 in the direction of the arrow indicated in FIG. 5 until top surface 12 of planar member 10 is disposed substantially directly above a receptacle (not shown) for excess objects which have been lodged in one or more recesses 20 of planar member 10. The excess objects which are not retained by the vacuum within the fluid passageway 22 of the respective recess 20 will fall out of the respective recess 20. Then, the target sheet 30 may receive the retained objects from the recesses of member 10 once switch 56 is activated as described above.

If desired, the planar members of this invention may be used to fill target sheets in accordance with this invention even without a vacuum pump system employing fluid passageways through the members and associated vacuum chambers and pumps. In such a case, the planar member is preferably configured as illustrated in FIG. 2B, so that the top surface of the planar member may be modified by removal of the rails to provide a bottom portion having a flat top surface when the target sheet is placed upon the planar member and the blister-like chambers are aligned with the recesses of the planar member. Of course, once aligned with each other, the sheet and planar member may then be manually flipped so that the contents of the planar member recesses fall into the chambers of the target sheet. Another embodiment of the invention could also provide that each rail be configured for attachment to the adjacent rail(s), e.g., by attaching adjacent ends of the rails to a crossbar or some other form of connecting means, so that all of the rails could be attached and removed substantially in unison with one another, thereby facilitating use of the planar member.

It should now be appreciated that the present invention provides an economical, yet commercially viable, solution to the packaging and accurate labeling of objects, and in particular small objects such as pharmaceutical products. In preferred embodiments of the invention, the system may be a table-top configuration which permits small offices and institutional operations alike to package and properly label materials in easy-to-dispense blister packs such as those described herein. It should also be apparent that, when desired, the systems, devices and methods of this invention enable the loading of multiple objects into each individual blister-like chamber of the target sheet, so that unit doses and multiple doses may be loaded into each chamber when desired. To do so would be a matter of repeating the loading procedure for each individual object to be placed in a chamber of the target sheet, and placing the adhesive backing bearing the desired information on the sheet once the desired contents is placed therein.

Each and every patent, patent application and printed publication referred to above is incorporated herein by reference in toto to the fullest extent permitted as a matter of law.

It should be appreciated that, while specific embodiments are described hereinafter, several other applications of the presently described invention may be contemplated by those of skill in the art in view of this disclosure. Accordingly, the scope of this invention is not limited to the specific embodiments described in detail hereinafter. Rather, what is intended to be covered is as set forth in the ensuing claims and the equivalents thereof permitted as a matter of law. As used in this specification, means-plus-function clauses, if any, are intended to cover the structures described herein as performing the cited function and not only structural equivalents but also equivalent structures.

What is claimed is:

1. A method of packaging a quantity of objects, the method comprising (a) placing a plurality of the objects on a top surface of a planar member which defines an array of recesses, each of the recesses being sized and configured to receive one of the objects, and which planar member further defines a plurality of fluid passageways extending through the planar member, each of the plurality of fluid passageways opening in a respective one of the recesses defined by the planar member and extending completely through the planar member to a passageway opening in a bottom surface of the planar member, (b) sweeping at least some of the plurality of the objects across the top surface to insure that each of the recesses has received a respective one of the objects, (c) removing all of any excess number of the objects from the top surface, (d) providing a vacuum in the space proximate to each of the passageway openings in the bottom surface of the planar member, the vacuum being sufficient to retain each object within its respective recess at least during rotation of the planar member, (e) placing in contact with, or at least in close proximity to, the top surface a sheet which forms an array of blister-like chambers for receiving a plurality of objects, the array of recesses of the top surface being substantially aligned with and opening into the blister-like chambers of the sheet, (f) while retaining the sheet in contact with or in close proximity to the top surface, rotating the planar member so that the bottom surface is substantially above the top surface, and (g) removing the vacuum from the space proximate to the passageway openings in the bottom surface to cause each object to fall from its respective recess into a corresponding blister-like chamber of the sheet.

2. A method according to claim 1 wherein the objects are pills, tablets, capsules or caplets.

3. A method according to claim 1, further comprising the step of (h) placing an adhesive-backed, backing into adhering contact with the sheet to thereby enclose each of the objects within a respective one of the blister-like chambers of the sheet.

4. A method according to claim 3 wherein the objects are pills, tablets, capsules or caplets.

5. A method according to claim 3, further comprising the step of (i) placing visual or machine readable markings upon the backing, the visual or machine readable markings be configured to convey information about the contents to be enclosed within each blister-like chamber.

6. A method according to claim 5 wherein the objects are pills, tablets, capsules or caplets.

* * * * *